US010348028B2

(12) United States Patent
Hayashi et al.

(10) Patent No.: US 10,348,028 B2
(45) Date of Patent: Jul. 9, 2019

(54) ELECTRICAL CONNECTOR HAVING SIMPLIFIED MANUFACTURING PROCESSES

(71) Applicant: SMK CORPORATION, Tokyo (JP)

(72) Inventors: Osamu Hayashi, Tokyo (JP); Naoyuki Ono, Tokyo (JP)

(73) Assignee: SMK CORPORATION, Tokyo (JP)

( * ) Notice: Subject to any disclaimer, the term of this patent is extended or adjusted under 35 U.S.C. 154(b) by 20 days.

(21) Appl. No.: 15/542,157

(22) PCT Filed: Jul. 7, 2016

(86) PCT No.: PCT/JP2016/070756
§ 371 (c)(1),
(2) Date: Jul. 7, 2017

(87) PCT Pub. No.: WO2017/047214
PCT Pub. Date: Mar. 23, 2017

(65) Prior Publication Data

US 2018/0269620 A1 Sep. 20, 2018

(30) Foreign Application Priority Data

Sep. 18, 2015 (JP) ..... 2015-184684

(51) Int. Cl.
*H01R 24/00* (2011.01)
*H01R 33/00* (2006.01)
(Continued)

(52) U.S. Cl.
CPC ..... *H01R 13/514* (2013.01); *H01R 13/405* (2013.01); *H01R 13/436* (2013.01);
(Continued)

(58) Field of Classification Search
CPC .... H01R 13/514; H01R 13/436; H01R 13/62; H01R 13/6582; H01R 24/60; H01R 24/78
(Continued)

(56) References Cited

U.S. PATENT DOCUMENTS 7,883,372 B1 * 2/2011 Sun ..... H01R 13/6582 439/607.55
9,022,800 B2 * 5/2015 Yang ..... H01R 13/6581 439/487
(Continued)

FOREIGN PATENT DOCUMENTS

CN 204103125 U 1/2015
CN 204103127 U 1/2015
(Continued)

OTHER PUBLICATIONS

International Search Report issued in PCT/JP2016/070756 dated Sep. 27, 2016 (6 pages).
(Continued)

*Primary Examiner* — Hae Moon Hyeon
(74) *Attorney, Agent, or Firm* — Osha Liang LLP

(57) ABSTRACT

An electrical connector includes an insulating main housing including a main body portion that has a holding hole open rearward and a plate-shaped fitting portion that protrudes forward from the main body portion and fits to a mating connector; a shield member that covers the main housing; an insulating sub housing that is arranged in the holding hole; and a plurality of conductive terminals that include connection portions arranged on the fitting portion and terminal portions protruding from the holding hole, and are held by the sub housing. The sub housing includes a first sub housing that is inserted into the holding hole from behind in a state of holding a part of the plurality of terminals, and a second sub housing that is inserted into the holding hole
(Continued)

from behind in a state of holding the terminals other than the part of the plurality of terminals.

17 Claims, 3 Drawing Sheets

(51) Int. Cl.

| | |
|---|---|
| ***H01R 13/514*** | (2006.01) |
| ***H01R 13/436*** | (2006.01) |
| ***H01R 13/62*** | (2006.01) |
| ***H01R 13/405*** | (2006.01) |
| ***H01R 13/506*** | (2006.01) |
| *H01R 24/60* | (2011.01) |
| *H01R 13/6582* | (2011.01) |
| *H01R 13/6595* | (2011.01) |

(52) U.S. Cl.
CPC ..... *H01R 13/506* (2013.01); *H01R 13/62* (2013.01); *H01R 13/6582* (2013.01); *H01R 13/6595* (2013.01); *H01R 24/60* (2013.01)

(58) Field of Classification Search
USPC ..... 439/660, 676, 607.4
See application file for complete search history.

(56) References Cited

U.S. PATENT DOCUMENTS

| | | | | |
|---|---|---|---|---|
| 2010/0068934 | A1* | 3/2010 | Li | H01R 13/627 439/607.55 |
| 2011/0159747 | A1 | 6/2011 | Tung et al. | |
| 2014/0349514 | A1 | 11/2014 | Yang et al. | |
| 2016/0020568 | A1* | 1/2016 | Ju | H01R 24/78 439/607.01 |
| 2016/0064872 | A1* | 3/2016 | Leng | H01R 24/60 439/607.05 |
| 2016/0064877 | A1* | 3/2016 | Tamaki | H01R 13/508 439/676 |
| 2017/0085039 | A1* | 3/2017 | Yokoyama | H01R 13/648 |
| 2018/0131145 | A1* | 5/2018 | Zhao | H01R 13/04 |
| 2018/0138638 | A1* | 5/2018 | Zhao | H01R 13/405 |
| 2018/0145460 | A1* | 5/2018 | Ju | H01R 13/631 |
| 2018/0205177 | A1* | 7/2018 | Zhou | H01R 13/631 |
| 2018/0212338 | A1* | 7/2018 | Chang | H01R 13/6586 |

FOREIGN PATENT DOCUMENTS

| | | | |
|---|---|---|---|
| CN | 204271328 | U | 4/2015 |
| JP | H06-062489 | U | 9/1994 |
| JP | 2001-230027 | A | 8/2001 |
| JP | 2007-172942 | A | 7/2007 |
| JP | 2009-043723 | A | 2/2009 |
| JP | 3160343 | U | 6/2010 |
| JP | 2015-005383 | A | 1/2015 |
| JP | 3198686 | U | 7/2015 |
| JP | 3198932 | U | 7/2015 |
| JP | 5292201 | B2 | 3/2018 |

OTHER PUBLICATIONS

Written Opinion of the International Searching Authority issued in PCT/JP2016/070756 dated Sep. 27, 2016 (4 pages).
Notification of Reasons for Refusal issued in Japanese Application No. 2018-013443, dated Feb. 13, 2019 (7 pages).
Office Action issued in Chinese Application No. 201680002243.6, dated Jan. 25, 2019 (9 pages).

* cited by examiner

ELECTRICAL CONNECTOR HAVING SIMPLIFIED MANUFACTURING PROCESSES

CROSS-REFERENCE TO RELATED APPLICATION

This is a national stage application based on PCT/JP2016/070756, filed on Jul. 7, 2016, which claims priority from Japanese Patent Application No. 2015-184684 filed on Sep. 18, 2015. The content of the priority applications are hereby incorporated by reference in their entirety.

TECHNICAL FIELD

The present invention relates to an electrical connector.

BACKGROUND

Conventionally, there are various types of electrical connectors to be mounted on electronic devices, depending on the mounting positions and the like of the electrical connectors on the electronic devices. Examples of such types include a vertical type of which an electrical connector is vertically placed on a substrate, and a horizontal type of which an electrical connector is horizontally placed on a substrate (for example, Patent Literature 1).

As the functionality of electronic devices increases and becomes sophisticated in recent years, demand has been growing for multipolar configuration of electrical connectors to be mounted on the electronic devices. More and more electrical connectors are being equipped with a plurality of rows of terminals accordingly.

CITATION LIST

Patent Literature

Patent Literature 1: Japanese Patent Application Laid-Open No. 2015-005383

SUMMARY

With conventional electrical connectors, however, different housings, shield members, and terminals need to be prepared for respective types of electrical connectors. This means a lack of versatility in manufacturing a plurality of different types of electrical connectors. The parts count may increase and the manufacturing cost may also increase, and the need to manage the parts type by type may complicate the manufacturing processes.

One or more embodiments of the present invention provide an electrical connector in which some of the parts can be shared among different types to enhance versatility in manufacturing different types of electrical connectors, suppress an increase in parts count to suppress an increase in manufacturing cost, and reduce the number of parts to be managed to simplify the manufacturing processes.

An electrical connector according to the present invention includes: an insulating main housing including a main body portion that has a holding hole open rearward and a plate-shaped fitting portion that protrudes forward from the main body portion and fits to a mating connector; a shield member that covers the main housing; an insulating sub housing that is arranged in the holding hole; and a plurality of conductive terminals that include connection portions arranged on the fitting portion and terminal portions protruding from the holding hole, and are held by the sub housing, wherein the sub housing includes a first sub housing that is inserted into the holding hole from behind in a state of holding a part of the plurality of terminals, and a second sub housing that is inserted into the holding hole from behind in a state of holding the terminals other than the part of the plurality of terminals.

In manufacturing a plurality of different types of electrical connectors, some terminals held by the first sub housing and the other terminals held by the second sub housing are changed with respect to each type of electrical connector. The shield member and the main housing are shared among the types.

According to the present invention, some of the parts are shared among different types. In manufacturing a plurality of different types of electrical connectors, an increase in parts count can thus be suppressed to suppress an increase in manufacturing cost, and the number of parts to be managed can be reduced to simplify the manufacturing processes.

DETAILED DESCRIPTION

Figure 1:
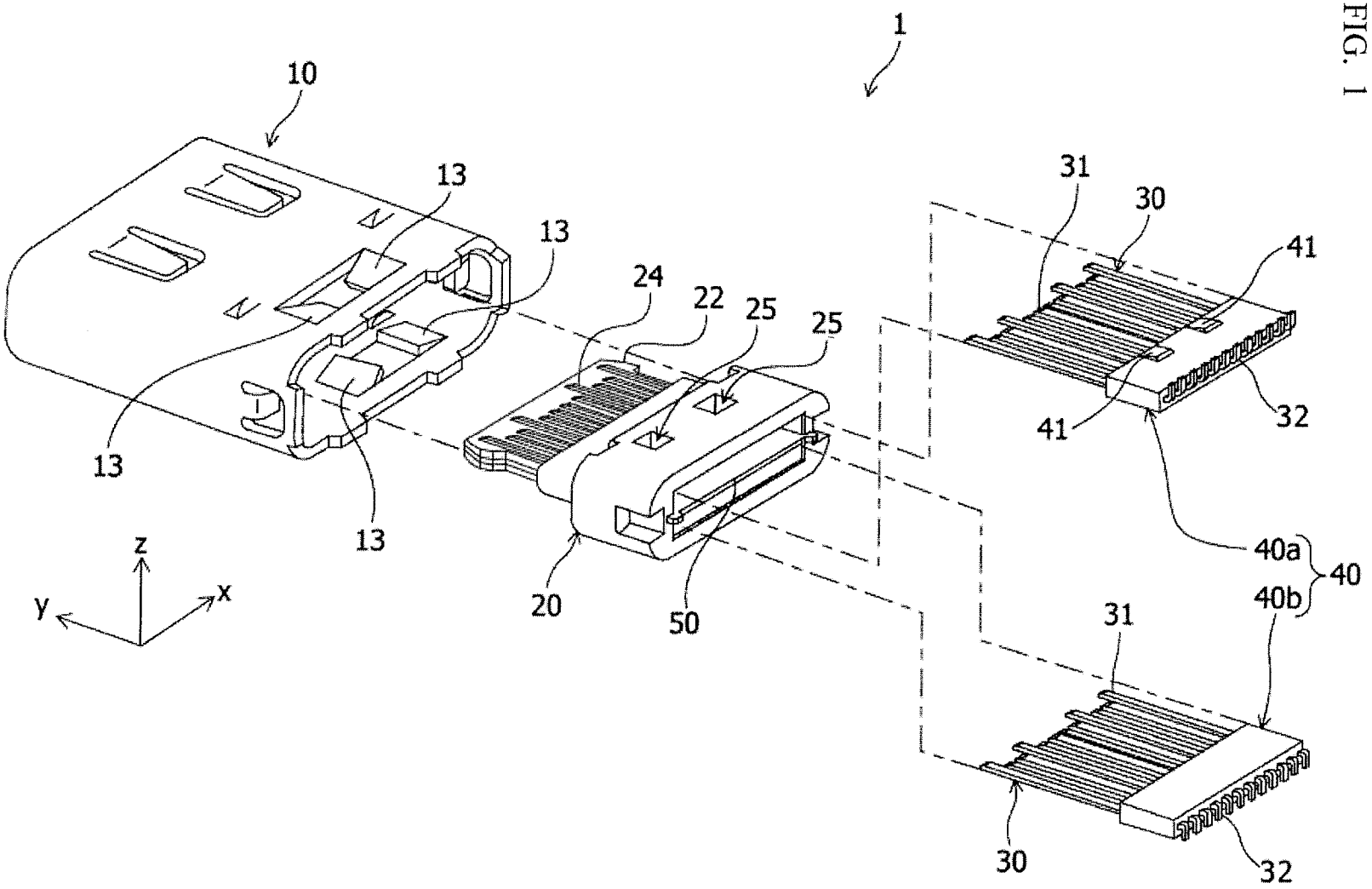
FIG. 1 is an exploded perspective view of a vertical electrical connector according to one or more embodiments of the present invention.
Figure 2:
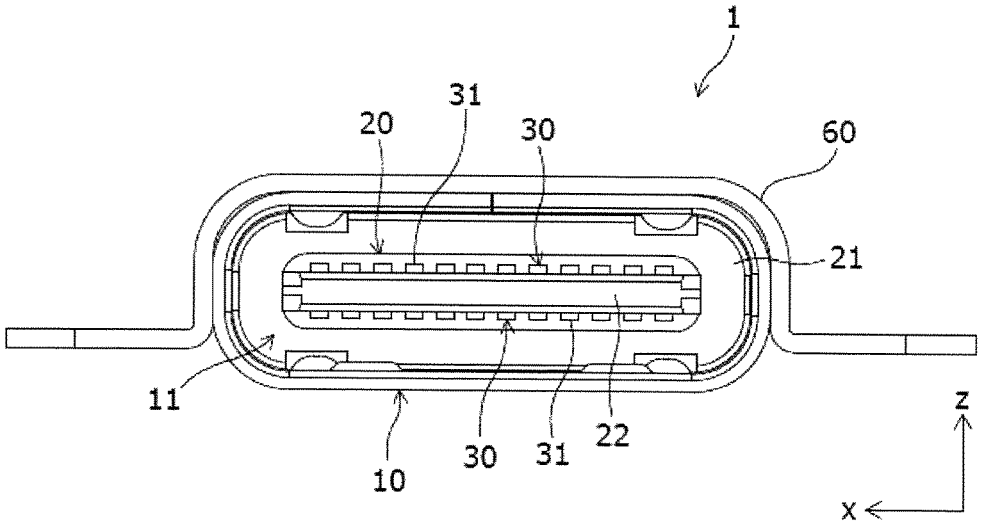
FIG. 2 is a front view of the vertical electrical connector according to one or more embodiments of the present invention.
Figure 3:
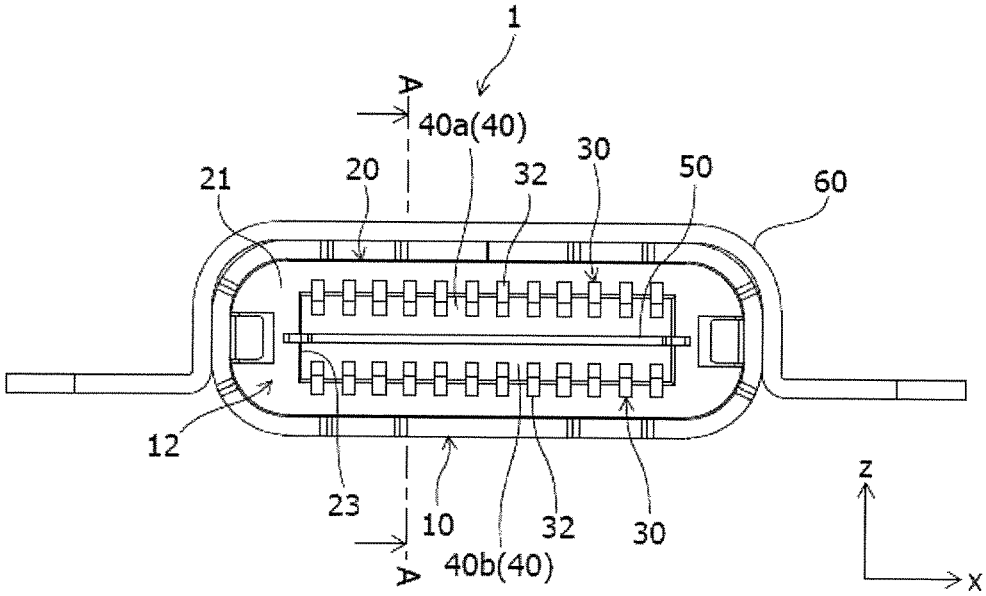
FIG. 3 is a rear view of the vertical electrical connector according to one or more embodiments of the present invention.

Hereinafter, an electrical connector according to an embodiment of the present invention will be described in detail with reference to the drawings as appropriate. In the drawings, an x-axis, a y-axis, and a z-axis constitute a three-axis orthogonal coordinate system. A positive direction of the y-axis will be described as a forward direction, a negative direction of the y-axis a rearward direction, the x-axis direction a lateral direction, a positive direction of the z-axis an upward direction, and a negative direction of the z-axis a downward direction.

<Configuration of Vertical Electrical Connector>

Figure 4:
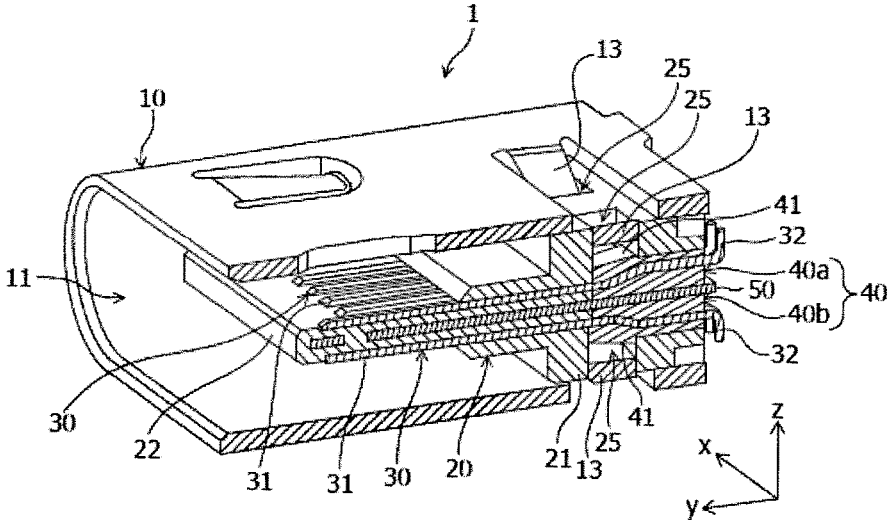
FIG. 4 is a cross-sectional perspective view taken along the line A-A of FIG. 3.

A configuration of a vertical electrical connector 1 according to the embodiment of the present invention will be described in detail below with reference to FIGS. 1 to 4. In FIGS. 1 and 4, a flange member 60 is omitted.

The electrical connector 1 is of a vertical type which is vertically placed on a not-shown substrate. The vertical electrical connector 1 is mounted on a substrate orthogonal to the y-axis direction. The electrical connector 1 includes a shield member 10, a main housing 20, terminals 30, sub housings 40, and a shielding plate 50.

The shield member 10 includes an insertion portion 11 which is open forward to allow insertion of a not-shown mating connector, an opening 12 which is open rearward, and locking pieces 13 which are bent inward. The locking pieces 13 are provided in right and left, two positions of an upper surface of the shield member 10 and in right and left, two positions of a lower surface of the shield member 10.

The shield member 10 covers the main housing 20. The locking pieces 13 are engaged with the inner walls of through holes 25 formed in a main body portion 21 of the main housing 20 (see FIG. 4). The shield member 10 is provided with a flange member 60 which is fixed to the not-shown substrate or the like and grounded (see FIGS. 2 and 3).

The main housing 20 is made of an insulating material and accommodated in the shield member 10. The main housing 20 includes the main body portion 21 and a plate-shaped fitting portion 22 which protrudes forward from the main body portion 21. The main body portion 21 has a holding hole 23 which is open rearward, and the through holes 25 which run through in a thickness direction and make the holding hole 23 communicate with outside. The through holes 25 are formed in right and left, two positions of an upper surface of the main housing 20 and in right and left, two positions of a lower surface of the main housing 20. The main housing 20 has insertion grooves 24 which are formed in the fitting portion 22. The insertion grooves 24 are extended rearward from the fitting portion 22 and communicate with the holding hole 23 at the rear ends.

The terminals 30 are made of a conductive material. A plurality of terminals 30 are provided and held by the sub housings 40. Some of the plurality of terminals 30 are held by a sub housing 40*a*. The others of the plurality of terminals 30 are held by a sub housing 40*b*.

The terminals 30 include connection portions 31 which are arranged in the insertion grooves 24 formed in the fitting portion 22, and terminal portions 32 which protrude from the holding hole 23. The connection portions 31 of the terminals 30 held by the sub housing 40*a* are laterally spaced and arranged on an upper surface, or one surface, of the fitting portion 22. The connection portions 31 of the terminals 30 held by the sub housing 40*b* are laterally spaced and arranged on a lower surface which is a surface opposite from the upper surface of the fitting portion 22. The terminal portions 32 protruding from the sub housing 40*a* protrude from the sub housing 40*a* in an upward direction which is a direction orthogonal to the longitudinal direction (front-to-rear direction) of the terminals 30. The terminal portions 32 protruding from the sub housing 40*b* protrude from the sub housing 40*b* in a downward direction which is a direction orthogonal to the longitudinal direction of the terminals 30. The terminals 30 held by the sub housing 40*a* and the terminals 30 held by the sub housing 40*b* have the same configuration.

The sub housings 40 include the sub housing 40*a* which is a first sub housing and is arranged above, and the sub housing 40*b* which is a second sub housing and is arranged below. The sub housing 40*a* and the sub housing 40*b* are made of an insulating material and arranged in the holding hole 23. The sub housing 40*a* and the sub housing 40*b* hold the terminals 30. The sub housing 40*a* and the sub housing 40*b* have the same configuration. The sub housing 40*a* and the sub housing 40*b* have engagement protrusions 41 (see FIG. 4) which are engaged with the inner walls of the through holes 25 formed in the main body portion 21 of the main housing 20.

The shielding plate 50 is made of a conductive material, has a plate-like shape, and is arranged on the main housing 20. The shielding plate 50 is arranged between the sub housing 40*a* and the sub housing 40*b*. The shielding plate 50 is arranged between the connection portions 31 of the terminals 30 held by the sub housing 40*a* and the connection portions 31 of the terminals 30 held by the sub housing 40*b*.

The electrical connector 1 having the foregoing configuration includes two unit members, that is, a unit member constituted by the sub housing 40*a* and the terminals 30 and a unit member constituted by the sub housing 40*b* and the terminals 30. The two unit members have the same configuration and are arranged in the main housing 20 in mutually vertically reversed states.

<Configuration of Horizontal Electrical Connector>

A configuration of a horizontal electrical connector 2 according to the embodiment of the present invention will be described in detail below with reference to FIG. 5.

Figure 5:
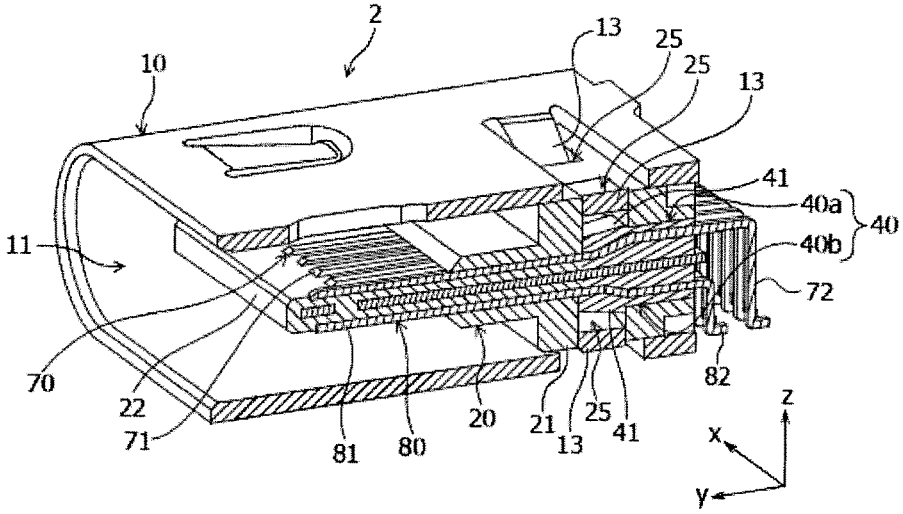
FIG. 5 is a cross-sectional perspective view of a horizontal electrical connector according to the embodiment of the present invention, corresponding to the line A-A of FIG. 3.

In FIG. 5, portions having the same configuration as in FIGS. 1 to 4 are designated by the same reference numerals. A description thereof will be omitted.

The electrical connector 2 is of a horizontal type which is horizontally placed on a not-shown substrate. The horizontal electrical connector 2 is mounted on a substrate orthogonal to the z-axis direction. The electrical connector 2 includes the shield member 10, the main housing 20, the sub housings 40, the shielding plate 50, terminals 70, and terminals 80.

The terminals 70 are made of a conductive material and held by the sub housing 40*a*. The terminals 70 include connection portions 71 which are arranged in insertion grooves 24 formed in the fitting portion 22, and terminal portions 72 which protrude from the holding hole 23. The connection portions 71 are laterally spaced and arranged on the upper surface of the fitting portion 22 of the main housing 20. The terminal portions 72 protrude from the sub housing 40*a* rearward, i.e., in a direction parallel to the longitudinal direction (front-to-rear direction) of the terminals 70.

The terminals 80 are made of a conductive material and held by the sub housing 40*b*. The terminals 80 include connection portions 81 which are arranged in insertion grooves 24 formed in the fitting portion 22, and terminal portions 82 which protrude from the holding hole 23. The connection portions 81 are laterally spaced and arranged on the lower surface of the fitting portion 22. The terminal portions 82 protrude from the sub housing 40*b* rearward, i.e., in a direction parallel to the longitudinal direction (front-to-rear direction) of the terminals 80.

The shielding plate 50 is arranged between the sub housing 40*a* and the sub housing 40*b*, and between the connection portions 71 of the terminals 70 and the connection portions 81 of the terminals 80.

<Method for Assembling Vertical Electrical Connector>

A method for assembling the vertical electrical connector 1 according to the embodiment of the present invention will be described in detail below.

Initially, a metal plate is pressed to form the shield member 10. Here, the metal plate is stamped out and then bent to form the locking pieces 13.

The sub housing 40*a* integrally holding the terminals 30 and the sub housing 40*b* integrally holding the terminals 30 are each formed by insert molding. The terminal portions 32 of the terminals 30 held by the sub housing 40*a* are formed by integrally holding the terminals 30 by the sub housing 40*a* and then bending the terminals 30 in the direction orthogonal to the longitudinal direction thereof. The terminal portions 32 of the terminals 30 held by the sub housing 40*b* are formed by integrally holding the terminals 30 by the sub housing 40*b* and then bending the terminals 30 in the direction orthogonal to the longitudinal direction thereof.

The main housing 20 integrally holding the shielding plate 50 is further formed by insert molding.

After the shield member 10, the sub housing 40*a* holding the terminals 30, the sub housing 40*b* holding the terminals 30, and the main housing 20 holding the shielding plate 50 described above are prepared, the sub housing 40*a* holding the terminals 30 is inserted, from behind, into either one of the upper and lower sections of the holding hole 23 partitioned by the shielding plate 50 (see FIG. 1). Since the holding hole 23 is vertically partitioned by the shielding plate 50, the sub housing 40*a* can be easily positioned and inserted into the holding hole 23. The sub housing 40*a* and the sub housing 40*b* have the same configuration, and the terminals 30 held by the sub housing 40*a* and the terminals 30 held by the sub housing 40*b* have the same configuration. The terminals 30 and the sub housings 40 to be inserted into the holding hole 23 therefore do not need to be sorted out. This can improve operability and allows easy manufacturing.

The sub housing 40*a* is inserted into the holding hole 23 in such a state that the engagement protrusions 41 are in press contact with inner wall of the holding hole 23 of the main body portion 21 and the shielding plate 50 is elastically deformed.

The connection portions 31 of the terminals 30 integrally held by the sub housing 40*a* are pressed in the insertion grooves 24 and, in such a state, move forward along the insertion grooves 24.

As the engagement protrusions 41 of the sub housing 40*a* reach the positions of the through holes 25 in the main body portion, the press contact state between the engagement protrusions 41 and the inner wall of the holding hole 23 is released and the shielding plate 50 returns to the original position by its own elastic force. The engagement protrusions 41 are thereby engaged with the inner walls of the through holes 25. The connection portions 31 are pressed into and held by the insertion grooves 24. As a result, the terminals 30 and the sub housing 40*a* are held by the main housing 20.

Next, the sub housing 40*b* holding the terminals 30 is inserted, from behind, into the other section of the holding hole 23 vertically partitioned by the shielding plate 50. Since the holding hole 23 is vertically partitioned by the shielding plate 50, the sub housing 40*b* can be easily positioned and inserted into the holding hole 23. If the sub housing 40*a* comes down before the insertion of the sub housing 40*b* into the holding hole 23, the sub housing 40*a* is pressed upward by the biasing force of the shielding plate 50. This can prevent the sub housing 40*a* from interfering with the insertion of the sub housing 40*b* into the holding hole 23. Moreover, the sub housing 40*a* and the sub housing 40*b* have the same configuration, and the terminals 30 held by the sub housing 40*a* and the terminals 30 held by the sub housing 40*b* have the same configuration. The terminals 30 and the sub housings 40 to be inserted into the holding hole 23 therefore do not need to be sorted out. This can improve the operability and allows easy manufacturing.

The sub housing 40*b* is inserted into the holding hole 23 with the engagement protrusions 41 in press contact with the inner wall of the holding hole 23 of the main body portion 21.

The connection portions 31 of the terminals 30 integrally held by the sub housing 40*b* are pressed into the insertion grooves 24 and, in such a state, move forward along the insertion grooves 24.

As the engagement protrusions 41 of the sub housing 40*b* reach the positions of the through holes 25 in the main body portion, the press contact state between the engagement protrusions 41 and the inner wall of the holding hole 23 is released and the engagement protrusions 41 are engaged with the inner walls of the through holes 25. The connection portions 31 are pressed into and held by the insertion grooves 24. As a result, the terminals 30 and the sub housing 40*b* are held by the main housing 20.

Next, the main housing 20 holding the terminals 30, the sub housing 40*a*, and the sub housing 40*b* is inserted into the shield member 10 from the opening 12.

The main housing 20 is inserted into the shield member 10 in such a state that the locking pieces 13 of the shield member 10 are elastically deformed outward.

As the through holes 25 of the main body portion 21 reach the positions of the locking pieces 13 of the shield member 10, the locking pieces 13 are engaged with the inner walls of the through holes 25 by the elastic restoring force of the locking pieces 13. The main housing 20 is thus held by the shield member 10.

Finally, if needed, the flange member 60 is attached to the shield member 10 to complete the assembly of the electrical connector 1. While the sub housings 40 are held by the main housing 20 before the main housing 20 is held by the shield member 10, the main housing 20 may be held by the shield member 10 before the sub housings 40 are held by the main housing 20. While the sub housing 40*a* is inserted into the holding hole 23 before the sub housing 40*b* is inserted into the holding hole 23, the sub housing 40*b* may be inserted into the holding hole 23 before the sub housing 40*a* is inserted into the holding hole 23.

<Method for Assembling Horizontal Electrical Connector>

A method for assembling the horizontal electrical connector 2 according to the embodiment of the present invention will be described in detail below.

Initially, a metal plate is pressed to form the shield member 10. Here, the metal plate is stamped out and then bent to form the locking pieces 13.

The sub housing 40*a* integrally holding the terminals 70 is formed by insert molding. The terminal portions 72 of the terminals 70 are formed by integrally holding the terminals 70 by the sub housing 40*a* and then bending the terminals 70 in a crank shape. The sub housing 40*b* integrally holding the terminals 80 is formed by insert molding. The terminal portions 82 of the terminals 80 are formed by integrally holding the terminals 80 by the sub housing 40*b* and then bending the terminals 80 in a crank shape.

The main housing 20 integrally holding the shielding plate 50 is further formed by insert molding.

After the shield member 10, the sub housing 40*a* holding the terminals 70, the sub housing 40*b* holding the terminals 80, and the main housing 20 holding the shielding plate 50 described above are prepared, the sub housing 40*a* holding the terminals 70 is inserted, from behind, into either one of the sections of the holding hole 23 vertically partitioned by the shielding plate 50. Since the holding hole 23 is vertically partitioned by the shielding plate 50, the sub housing 40*a* can be easily positioned and inserted into the holding hole 23.

The sub housing 40*a* is inserted into the holding hole 23 in such a state that the engagement protrusions 41 are in press contact with the inner wall of the holding hole 23 of the main body portion 21 and the shielding plate 50 is elastically deformed.

The connection portions 71 of the terminals 70 integrally held by the sub housing 40*a* are pressed into the insertion grooves 24 and, in such a state, move forward along the insertion grooves 24.

As the engagement protrusions 41 of the sub housing 40*a* reach the positions of the through holes 25 in the main body portion, the press contact state between the engagement protrusions 41 and the inner wall of the holding hole 23 is released and the engagement protrusions 41 are engaged with the inner walls of the through holes 25. The connection portions 71 are pressed into and held by the insertion grooves 24. As a result, the terminals 70 and the sub housing 40*a* are held by the main housing 20.

Next, the sub housing 40*b* holding the terminals 80 is inserted, from behind, into the other section of the holding hole 23 vertically partitioned by the shielding plate 50. Since the holding hole 23 is vertically partitioned by the shielding plate 50, the sub housing 40*b* can be easily positioned and inserted into the holding hole 23.

The sub housing 40*b* is inserted into the holding hole 23 with the engagement protrusions 41 in press contact with the inner wall of the holding hole 23 of the main body portion 21.

The connection portions 81 of the terminals 80 integrally held by the sub housing 40*b* are pressed into the insertion grooves 24 and, in such a state, move forward along the insertion grooves 24.

As the engagement protrusions 41 of the sub housing 40*b* reach the positions of the through holes 25 in the main body portion, the press contact state between the engagement protrusions 41 and the inner wall of the holding hole 23 is released and the engagement protrusions 41 are engaged with the inner walls of the through holes 25. The connection portions 31 are pressed into and held by the insertion grooves 24. As a result, the terminals 80 and the sub housing 40*b* are held by the main housing 20.

The subsequent method of assembly is the same as with the method for assembling the electrical connector 1. A description thereof will thus be omitted.

As described above, according to the present embodiment, there are provided the sub housing 40*a* which is inserted into the holding hole 23 from behind in a state of holding some of the terminals 30 and the sub housing 40*b* which is inserted into the holding hole 23 from behind in a state of holding the terminals 30 other than some of the terminals 30. Consequently, some of the parts are shared among different types. In manufacturing a plurality of different types of electrical connectors, an increase in parts count can thus be suppressed to suppress an increase in manufacturing cost, and the number of parts to be managed can be reduced to simplify the manufacturing processes.

According to the present embodiment, the sub housing 40*a* holding some of the terminals 30 has the same configuration as that of the sub housing 40*b* holding the other terminals 30. Consequently, some of the parts are further shared among different types. In manufacturing a plurality of different types of electrical connectors, an increase in parts count can thus be suppressed to suppress an increase in manufacturing cost, and the number of parts to be managed can be reduced to simplify the manufacturing processes.

According to the present embodiment, the terminal portions 32 of some of the terminals 30 are protruded from the holding hole 23 in a direction opposite from that in which the terminal portions 32 of the other terminals 30 are protruded from the holding hole 23. This enables the provision of the electrical connector 1 of a vertical type.

According to the present embodiment, some of the terminals 30 have the same configuration as that of the other terminals 30. When the sub housing 40*a* and the sub housing 40*b* are inserted into the holding hole 23 of the main housing 20, the terminals 30 therefore do not need to be sorted out. This allows easy assembly.

According to the present embodiment, the terminal portions 72 of the terminals 70 are protruded from the holding hole 23 in the same direction as that in which the terminal portions 82 of the terminals 80 are protruded from the holding hole 23. This enables the provision of the electrical connector 2 of a horizontal type.

According to the present embodiment, the plate-shaped shielding plate 50 arranged on the main housing 20 is further included. The connection portions 31 of some of the terminals 30 are arranged in the insertion grooves 24 formed in one surface of the fitting portion 22. The connection portions 31 of the other terminals 30 are arranged in the insertion grooves 24 formed in the surface opposite from the one surface of the fitting portion 22. The shielding plate 50 is arranged between the connection portions 31 of some of the terminals 30 and the connection portions 31 of the other terminals 30. This can prevent signals flowing through either some of the terminals 30 or the other terminals 30 from producing noise on signals flowing through the others of either some of the terminals 30 or the other terminals 30.

According to the present embodiment, the main body portion 21 includes the through holes 25 which make the holding hole 23 communicate vertically with outside. The shield member 10 includes the locking pieces 13 which are engaged with the inner walls of the through holes 25. The sub housings 40 include the engagement protrusions 41 which are engaged with the inner walls of the through holes 25. The portions for fixing the shield member 10 to the main housing 20 and the portions for fixing the sub housings 40 to the main housing 20 can thus be shared to simplify the configuration of the main housing 20 for easy manufacturing.

The present invention is not limited to the foregoing embodiment in terms of the types, arrangement, numbers, and the like of the members. Modifications may be made as appropriate without departing from the gist of the invention. For example, the components may be replaced with ones having equivalent operations and effects as appropriate.

Specifically, in the foregoing embodiment, parts are shared in manufacturing vertical and horizontal electrical connectors. However, the parts may also be shared in manufacturing electrical connectors of other types than vertical and horizontal ones, such as a mid-mount type.

While the foregoing embodiment includes the shielding plate 50, the shielding plate 50 may be dispensed with.

INDUSTRIAL APPLICABILITY

The present invention is suitable for an electrical connector including a plate-shaped fitting portion to be fitted to a mating connector.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

REFERENCE SIGNS LIST

1 electrical connector
2 electrical connector
10 shield member
11 insertion portion
12 opening
13 locking piece
20 main housing
21 main body portion
22 fitting portion

23 holding hole
24 insertion groove
25 through hole
30 terminal
31 connection portion
32 terminal portion
40 sub housing
40*a* sub housing
40*b* sub housing
41 engagement protrusion
50 shielding plate
60 flange member
70 terminal
71 connection portion
72 terminal portion
80 terminal
81 connection portion
82 terminal portion

The invention claimed is:

1. An electrical connector comprising:

an insulating main housing including a main body portion that has a holding hole open rearward and a plate-shaped fitting portion that protrudes forward from the main body portion and fits to a mating connector;

a shield member that covers the main housing;

an insulating sub housing that is arranged in the holding hole; and a plurality of conductive terminals that include connection portions arranged on the fitting portion and terminal portions protruding from the holding hole, and are held by the sub housing, wherein the sub housing includes a first sub housing that is inserted into the holding hole from behind in a state of holding a part of the plurality of terminals, and a second sub housing that is inserted into the holding hole from behind in a state of holding the terminals other than the part of the plurality of terminals; and the first sub housing has a same configuration as that of the second sub housing.

2. The electrical connector according to claim 1, wherein the terminal portions of the part of the terminals protrude from the holding hole in a direction opposite from that in which the terminal portions of the other terminals protrude from the holding hole.

3. The electrical connector according to claim 2, wherein the part of the terminals have the same configuration as that of the other terminals.

4. The electrical connector according to claim 3, further comprising a plate-shaped shielding plate that is arranged on the main housing, wherein:

the connection portions of the part of the terminals are arranged on one surface of the fitting portion;

the connection portions of the other terminals are arranged on a surface opposite from the one surface of the fitting portion; and the shielding plate is arranged between the connection portions of the part of the terminals and the connection portions of the other terminals.

5. The electrical connector according to claim 3, wherein:

the main body portion includes through holes each of which makes the holding hole communicate vertically with outside;

the shield member includes locking pieces each of which is engaged with an inner wall of each of the through holes;

the first sub housing includes a first engagement protrusion that is engaged with the inner wall of one of the through holes that engages with one of the locking pieces; and the second sub housing includes a second engagement protrusion that is engaged with the inner wall of another one of the through holes that engages with another one of the locking pieces.

6. The electrical connector according to claim 2, further comprising a plate-shaped shielding plate that is arranged on the main housing, wherein:

the connection portions of the part of the terminals are arranged on one surface of the fitting portion;

the connection portions of the other terminals are arranged on a surface opposite from the one surface of the fitting portion; and the shielding plate is arranged between the connection portions of the part of the terminals and the connection portions of the other terminals.

7. The electrical connector according to claim 2, wherein:

the main body portion includes through holes each of which makes the holding hole communicate vertically with outside;

the shield member includes locking pieces each of which is engaged with an inner wall of each of the through holes;

the first sub housing includes a first engagement protrusion that is engaged with the inner wall of one of the through holes that engages with one of the locking pieces; and the second sub housing includes a second engagement protrusion that is engaged with the inner wall of another one of the through holes that engages with another one of the locking pieces.

8. The electrical connector according to claim 1, wherein the terminal portions of the part of the terminals protrude from the holding hole in the same direction as that in which the terminal portions of the other terminals protrude from the holding hole.

9. The electrical connector according to claim 8, further comprising a plate-shaped shielding plate that is arranged on the main housing, wherein:

the connection portions of the part of the terminals are arranged on one surface of the fitting portion;

the connection portions of the other terminals are arranged on a surface opposite from the one surface of the fitting portion; and the shielding plate is arranged between the connection portions of the part of the terminals and the connection portions of the other terminals.

10. The electrical connector according to claim 8, wherein:

the main body portion includes through holes each of which makes the holding hole communicate vertically with outside;

the shield member includes locking pieces each of which is engaged with an inner wall of each of the through holes;

the first sub housing includes a first engagement protrusion that is engaged with the inner wall of one of the through holes that engages with one of the locking pieces; and the second sub housing includes a second engagement protrusion that is engaged with the inner wall of another one of the through holes that engages with another one of the locking pieces.

11. The electrical connector according to claim 1, further comprising a plate-shaped shielding plate that is arranged on the main housing, wherein:

the connection portions of the part of the terminals are arranged on one surface of the fitting portion;

the connection portions of the other terminals are arranged on a surface opposite from the one surface of the fitting portion; and the shielding plate is arranged between the connection portions of the part of the terminals and the connection portions of the other terminals.

12. The electrical connector according to claim 11, wherein:

the main body portion includes through holes each of which makes the holding hole communicate vertically with outside;

the shield member includes locking pieces each of which is engaged with an inner wall of each of the through holes;

the first sub housing includes a first engagement protrusion that is engaged with the inner wall of one of the through holes that engages with one of the locking pieces; and the second sub housing includes a second engagement protrusion that is engaged with the inner wall of another one of the through holes that engages with another one of the locking pieces.

13. The electrical connector according to claim 1, wherein:

the main body portion includes through holes each of which makes the holding hole communicate vertically with outside;

the shield member includes locking pieces each of which is engaged with an inner wall of each of the through holes;

the first sub housing includes a first engagement protrusion that is engaged with the inner wall of one of the through holes that engages with one of the locking pieces; and the second sub housing includes a second engagement protrusion that is engaged with the inner wall of another one of the through holes that engages with another one of the locking pieces.

14. The electrical connector according to claim 1, wherein the terminal portions of the part of the terminals protrude from the holding hole in a direction opposite from that in which the terminal portions of the other terminals protrude from the holding hole.

15. The electrical connector according to claim 1, wherein the terminal portions of the part of the terminals protrude from the holding hole in the same direction as that in which the terminal portions of the other terminals protrude from the holding hole.

16. The electrical connector according to claim 1, further comprising a plate-shaped shielding plate that is arranged on the main housing, wherein:

the connection portions of the part of the terminals are arranged on one surface of the fitting portion;

the connection portions of the other terminals are arranged on a surface opposite from the one surface of the fitting portion; and the shielding plate is arranged between the connection portions of the part of the terminals and the connection portions of the other terminals.

17. The electrical connector according to claim 1, wherein:

the main body portion includes through holes each of which makes the holding hole communicate vertically with outside;

the shield member includes locking pieces each of which is engaged with an inner wall of each of the through holes;

the first sub housing includes a first engagement protrusion that is engaged with the inner wall of one of the through holes that engages with one of the locking pieces; and the second sub housing includes a second engagement protrusion that is engaged with the inner wall of another one of the through holes that engages with another one of the locking pieces.

* * * * *